US009953736B2

(12) United States Patent
Otsuka et al.

(10) Patent No.: US 9,953,736 B2
(45) Date of Patent: Apr. 24, 2018

(54) ALUMINUM ELECTRIC WIRE FOR AN AUTOMOBILE AND A METHOD FOR PRODUCING THE SAME

(71) Applicants: AUTONETWORKS TECHNOLOGIES, LTD., Yokkaichi-Shi (JP); SUMITOMO WIRING SYSTEMS, LTD., Yokkaichi-Shi (JP); SUMITOMO ELECTRIC INDUSTRIES, LTD., Osaka-shi (JP); SUMITOMO ELECTRIC TOYAMA CO., LTD., Imizu-shi (JP)

(72) Inventors: Yasuyuki Otsuka, Yokkaichi (JP); Masanobu Yoshimura, Yokkaichi (JP); Kotaro Maeda, Yokkaichi (JP); Jun Yoshimoto, Yokkaichi (JP); Masashi Kimura, Yokkaichi (JP); Taichirou Nishikawa, Osaka (JP); Misato Kusakari, Osaka (JP); Shinichi Kitamura, Imizu (JP); Hiroaki Takai, Imizu (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD, Osaka (JP); SUMITOMO ELECTRIC TOYAMA CO., LTD., Imizu (JP)

( * ) Notice: Subject to any disclaimer, the term of this patent is extended or adjusted under 35 U.S.C. 154(b) by 957 days.

(21) Appl. No.: 13/897,111

(22) Filed: May 17, 2013

(65) Prior Publication Data

US 2013/0255840 A1 Oct. 3, 2013

Related U.S. Application Data

(62) Division of application No. 12/734,282, filed as application No. PCT/JP2008/069241 on Oct. 23, 2008, now Pat. No. 8,476,529.

(30) Foreign Application Priority Data

Oct. 23, 2007 (JP) ..... 2007-274659

(51) Int. Cl.
*H01B 13/06* (2006.01)
*H01B 1/02* (2006.01)
(Continued)

(52) U.S. Cl.
CPC ..... *H01B 1/023* (2013.01); *C22C 21/00* (2013.01); *C22F 1/02* (2013.01); *C22F 1/04* (2013.01);
(Continued)

(58) Field of Classification Search
CPC ..... H01B 13/06
(Continued)

(56) References Cited

U.S. PATENT DOCUMENTS 2,545,866 A * 3/1951 Whitzel ..... C22C 21/00 148/437
3,663,216 A 5/1972 Hunsicker
(Continued)

FOREIGN PATENT DOCUMENTS

JP A-2005-336549 12/2005
JP 2006019163 * 1/2006

OTHER PUBLICATIONS

English language machine translation of JP2006019163 to Yoshida et al. Generated Apr. 22, 2010.*
(Continued)

*Primary Examiner* — Brian Walck
(74) *Attorney, Agent, or Firm* — Oliff PLC

(57) ABSTRACT

An aluminum electric wire includes an annealing conductor that is made up of elemental wires made of an aluminum alloy containing 0.90-1.20 mass % Fe, 0.10-0.25 mass %
(Continued)

Mg, 0.01-0.05 mass % Ti, 0.0005-0.0025 mass % B, and the balance being Al and has a tensile strength of 110 MPa or more, a breaking elongation of 15% or more, and an electric conductivity of 58% IACS or more, and an insulating material covering the conductor. The wire is produced by casting an aluminum alloy prepared by rapidly solidifying a molten aluminum alloy having the above composition, producing the wires by subjecting the alloy to plasticity processing, producing the conductor by bunching the wires, subjecting the wires or the conductor to annealing at 250° C. or higher, and then covering the conductor with the insulator.

9 Claims, 6 Drawing Sheets

(51) Int. Cl.
*C22C 21/00* (2006.01)
*C22F 1/02* (2006.01)
*C22F 1/04* (2006.01)
*H01B 13/00* (2006.01)

(52) U.S. Cl.
CPC ..... *H01B 13/0016* (2013.01); *H01B 13/06* (2013.01); *Y10T 29/49117* (2015.01)

(58) Field of Classification Search
USPC ..... 148/523, 550
See application file for complete search history.

(56) References Cited

U.S. PATENT DOCUMENTS

| | | | |
|---|---|---|---|
| 3,670,401 | A | 6/1972 | Schoerner |
| 4,121,951 | A | 10/1978 | Fortin et al. |
| 4,127,426 | A | 11/1978 | Nicoud |
| 2008/0196923 | A1 | 8/2008 | Susai et al. |
| 2011/0036614 | A1 | 2/2011 | Otsuka et al. |
| 2011/0140517 | A1 | 6/2011 | Kusakari et al. |

OTHER PUBLICATIONS

Jun. 16, 2015 Office Action issued in European Patent Application No. 08 842 360.3.
Jul. 2, 2013 Office Action issued in Japanese Patent Application No. 2011-141675 (with translation).
Sep. 12, 2013 Extended European Search Report issued in Patent Application No. 13170781.2.
Jan. 7, 2014 Office Action issued in European Patent Application No. 13 170 781.2.
Apr. 9, 2014 Office Action issued in European Patent Application No. 13 170 781.2.
Aug. 31, 2016 Extended European Search Report issued in European Patent Application No. 16172723.5.
Jan. 17, 2017 Office Action issued in European Patent Application No. 16172723.5.

* cited by examiner

ALUMINUM ELECTRIC WIRE FOR AN AUTOMOBILE AND A METHOD FOR PRODUCING THE SAME

This application is a divisional of application Ser. No. 12/734,282, filed Apr. 22, 2010, the contents of which are incorporated herein by reference in their entirety.

TECHNICAL FIELD

The present invention relates to an aluminum electric wire for an automobile and a method for producing the same.

BACKGROUND ART

Aluminum electric wires having a conductor made of an aluminum-based material have conventionally been used in the field of electric power industry providing overhead power lines, as being reduced in weight and excellent in electric conductivity. Aluminum alloys have been increasingly used in conductors of aluminum electric wires, the majority of which are Al—Fe alloys, to improve strength and bending resistance.

As the materials for those wires, Triple-E manufactured by Southwire Company, SI-16 manufactured by Sumitomo Electric Industries, Ltd., and the 8030 alloy according to The International Alloy Designation System (Al—0.3 to 0.8 Fe—0.05 to 0.15 Cu) are known for example.

Whereas in the automotive field, copper wires having a conductor made of a copper-based material with excellent electric conductivity are widely used as signal lines and electric power lines.

In the automotive field, the recent rapid advancement in the performance and functions of automobiles has increased the number of various electronic devices and control devices used in automobiles, which has accordingly increased the number of wires used therein. Consequently, attempts have been made to use aluminum electric wires having a conductor made of an aluminum material in order to reduce weight.

For example, Laid-Open Japanese Patent Publication No. 2006-19163 discloses an aluminum conductor that is a strand prepared by bunching aluminum alloy elemental wires containing 1.10-1.50 mass % Fe, 0.03-0.25% mass % Mg, 0.02-0.06 mass % Si, and the balance being Al and incidental impurities.

DISCLOSURE OF THE INVENTION

Problem to be Solved by the Invention

However, when a conventional Al—Fe alloy containing 0.9 mass % or more Fe is used for a conductor, a defect such as a crack occurring in a rolling process tends to occur in the conductor. In other words, when such an alloy, which has poor workability, is drawn into an elemental wire used for an electric wire having a diameter necessary for automobile use, the elemental wire tends to break due to a defect occurring in the rolling process. In addition, because conductors of electric wires used for an automobile are annealed, they are very susceptible to a defect occurring in the rolling process, and are therefore apt to decrease in strength and elongation, which results in decreased bending resistance and impact resistance of the electric wire.

In addition, the aluminum alloy elemental wire cited in Laid-Open Japanese Patent Publication No. 2006-19163 is a hard-drawn wire, so that while having improved strength, the wire is poor in elongation, which results in decreased bending resistance and impact resistance.

An object of the present invention is to provide an aluminum electric wire for an automobile having excellent tensile strength and workability, and bending resistance and impact resistance, while having reduced weight and sufficient electric conductivity as a conductor, and a method for producing the same.

Means to Solve the Problem

To achieve the objects and in accordance with the purpose of the present invention, an aluminum electric wire for an automobile according to a preferred embodiment of the present invention includes an annealed conductor that is made up of elemental wires made of an aluminum alloy containing 0.90 to 1.20 mass % Fe, 0.10 to 0.25 mass % Mg, and the balance being Al and incidental impurities, and an insulating material covering the annealed conductor.

It is preferable that the aluminum alloy further contains 0.01 to 0.05 mass % Ti.

It is preferable that the aluminum alloy further includes 0.0005 to 0.0025 mass % B in addition to the Ti.

It is preferable that the annealed conductor made up of the elemental wires made of the aluminum alloy has a tensile strength of 110 MPa or more, a breaking elongation of 15% or more, and an electric conductivity of 58% IACS or more.

It is preferable that the quantity of Al—Fe precipitates in an area of 2400×2600 nm in a cross section of the annealed conductor is five or more.

It is preferable that the annealed conductor is compressed concentrically.

A method for producing an aluminum electric wire for an automobile according to a preferred embodiment of the present invention includes the steps of casting an aluminum alloy that is prepared by rapidly solidifying a molten aluminum alloy containing 0.90 to 1.20 mass % Fe, 0.10 to 0.25 mass % Mg, and the balance being Al and incident impurities, producing an aluminum alloy conductor from the aluminum alloy by subjecting the aluminum alloy to plasticity processing, making the aluminum alloy conductor into an annealed conductor by subjecting the aluminum alloy conductor to annealing, and covering the aluminum alloy conductor with an insulating material.

It is preferable that 0.01 to 0.05 mass % Ti is added to the molten aluminum alloy immediately before the rapid solidification.

It is preferable that 0.0005 to 0.0025 mass % B is added to the molten aluminum alloy in addition to the Ti immediately before the rapid solidification.

It is preferable that the aluminum alloy conductor is made into an annealed conductor by the annealing at a temperature of 250° C. or higher.

The annealing is preferably batch-type annealing. It is desired that a heating temperature for the batch-type annealing is in the range of from 250 to 400° C., and that a cooling time necessary to cool the aluminum alloy conductor from the annealing temperature to 150° C. is ten minutes or longer.

The annealing may be continuous annealing using electric heating.

Alternatively, the annealing may be continuous annealing using high-frequency induction heating.

It is preferable that the annealing is performed under a non-oxidizing atmosphere.

It is preferable that the method further includes the step of concentrically compressing the aluminum alloy conductor.

Effects of the Invention

Including the annealed conductor that is made of elemental wires made of the aluminum alloy containing predetermined amounts of Fe and Mg, the aluminum electric wire for an automobile according to the preferred embodiment of the present invention is excellent in tensile strength and workability, and bending resistance and impact resistance, while having sufficient electric conductivity as a conductor. In addition, using the aluminum alloy as a wire material, the aluminum electric wire according to the present invention can be reduced in weight compared with a conventional copper wire.

Adding 0.01 to 0.05 mass % Ti to the aluminum alloy enables the aluminum alloy to have a microstructure. Accordingly, occurrence of a defect in rolling the aluminum alloy is minimized, preventing the workability of the alloy, and the strength and elongation of the aluminum electric wire from decreasing, even when 0.90 mass % or more Fe is contained in the alloy.

Adding 0.0005 to 0.0025 mass % B to the aluminum alloy in addition to the Ti further improves the beneficial effect of miniaturizing the crystalline structure of the aluminum alloy, which is produced by the addition of the Ti.

If the annealed conductor made up of elemental wires made of the aluminum alloy has a tensile strength of 110 MPa or more, a breaking elongation of 15% or more, and an electric conductivity of 58% IACS or more, the aluminum electric wire has bonding strength to a terminal and impact resistant energy sufficient for automobile use. Consequently, the alloy has excellent tensile strength, workability, bending resistance, and impact resistance enough to be used for a wire.

If the quantity of Al—Fe precipitates in an area of 2400×2600 nm in a cross section of the annealed conductor is five or more, the amount of Fe in the form of solid solution is small, and thus the annealed conductor is excellent in electric conductivity. In addition, decrease in the elongation of the conductor is minimized, and the electric wire has excellent bending resistance and impact resistance.

The concentric compression of the annealed conductor can reduce the wire diameter.

In the method for producing an aluminum electric wire for an automobile according to the preferred embodiment of the present invention, during the step of casting the aluminum alloy, molten aluminum alloy having the predetermined alloy composition is rapidly solidified, and thus Fe crystallizations are finely dispersed, which minimizes occurrence of a defect in the rolling process. In addition, the aluminum alloy conductor that is produced by subjecting the aluminum alloy to plasticity processing is subjected to annealing and made into the annealed conductor. By this method, an aluminum electric wire for an automobile having excellent tensile strength and workability, and bending resistance and impact resistance can be produced. The produced wire is reduced in weight compared with a conventional copper wire while having sufficient electric conductivity as a conductor.

Adding 0.01 to 0.05 mass % Ti to the molten aluminum alloy immediately before the rapid solidification enables the aluminum alloy to have a microstructure, thereby minimizing occurrence of a defect in rolling the aluminum alloy.

Adding 0.0005 to 0.0025 mass % B to the molten aluminum alloy in addition to the Ti immediately before the rapid solidification further improves the beneficial effect of microstructuring of the aluminum alloy, which is produced by the addition of the Ti.

If the aluminum alloy conductor is made into an annealed conductor by the annealing at a temperature of 250° C. or higher, the mechanical properties and electric properties described above are obtained easily.

If the annealing is batch-type annealing, the aluminum alloy conductor can be slowly cooled after the annealing. Thus, Fe in the solid solution is easily precipitated. In addition, the annealing temperature of the batch annealing is lower than that in the continuous annealing, allowing the precipitated Fe to be not easily incorporated into the solid solution again. Accordingly, the aluminum alloy conductor obtained with the batch annealing contains a small amount of Fe in the form of solid solution and thus has excellent electric conductivity. In addition, decrease in elongation of the conductor is minimized, which provides the electric wire with excellent bending resistance and impact resistance. These beneficial effects can be positively enhanced by setting the heating temperature and cooling rate within the respective ranges described above.

If the annealing is continuous annealing using electric heating, variations in characteristics in the longitudinal direction of the wire can be minimized. This beneficial effect can be produced also if the annealing is continuous annealing using high-frequency induction heating. In addition, allowing continuous heating and rapid cooling, the continuous annealing is suitably used for producing long objects such as wires.

Performing the annealing in a non-oxidizing atmosphere minimizes increase of an oxide layer on the surface of the aluminum elemental wires, which is caused by heat in the annealing, and thereby increase in the contact resistance at a terminal connection portion can be minimized.

If the method further includes the step of concentrically compressing the aluminum alloy conductor, the electric wire can be reduced in diameter.

BEST MODE FOR CARRYING OUT THE INVENTION

Figure 1A:
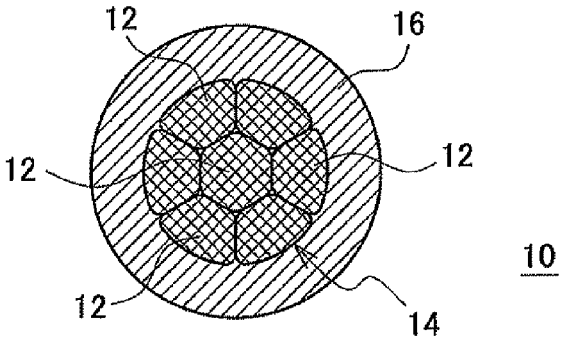
FIGS. 1A to 1D are sectional views showing examples of aluminum electric wires for an automobile according to preferred embodiments of the present invention.
Figure 1B:
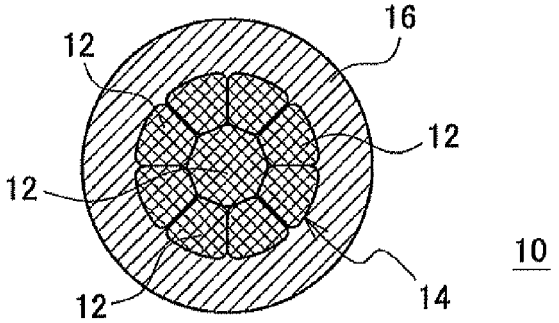
Figure 1C:
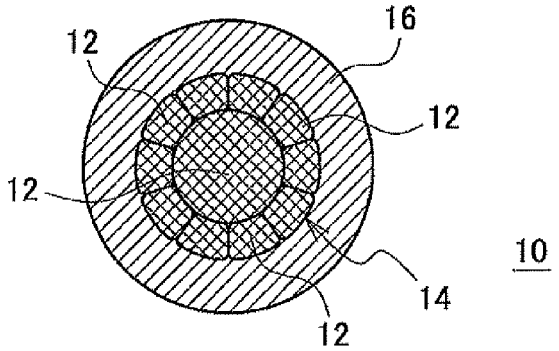
Figure 1D:
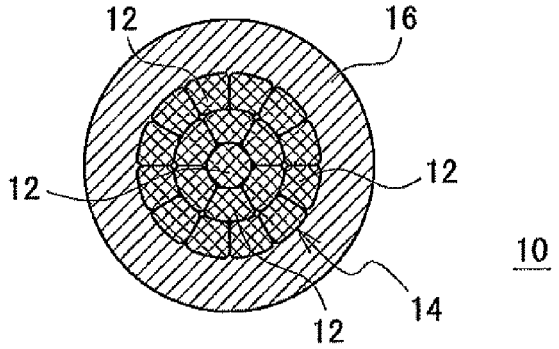
Figure 2A:
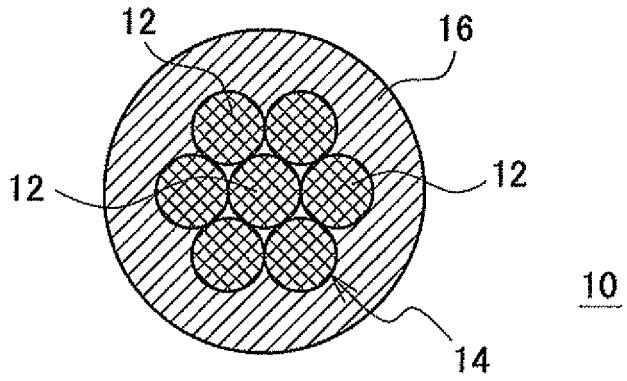
FIGS. 2A to 2C are sectional views showing examples of aluminum electric wires for an automobile according to preferred embodiments of the present invention.
Figure 2B:
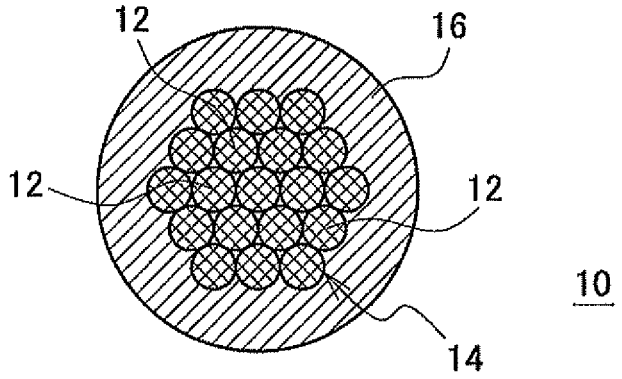
Figure 2C:
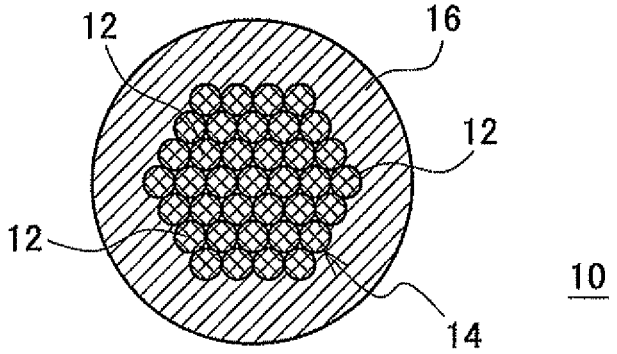
Figure 3A:
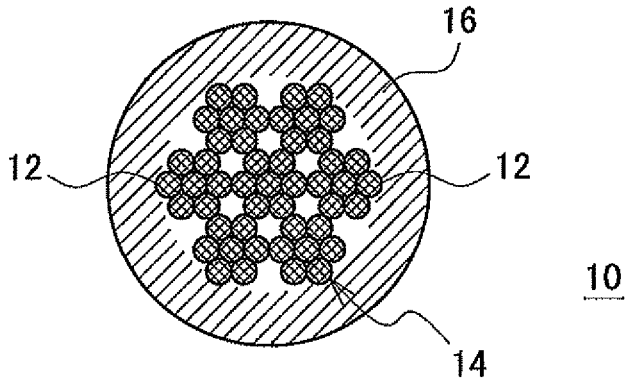
FIGS. 3A to 3B are sectional views showing examples of aluminum electric wires for an automobile according to preferred embodiments of the present invention.
Figure 3B:
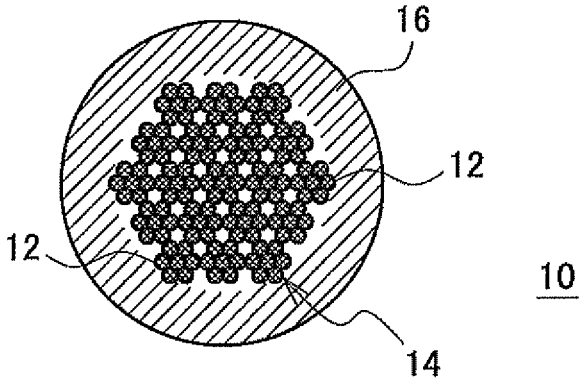
Figure 4A:
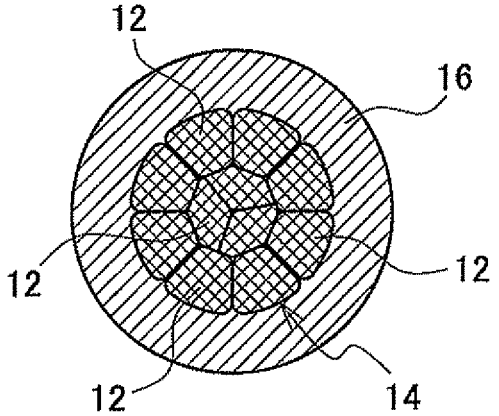
FIGS. 4A to 4B are sectional views showing examples of aluminum electric wires for an automobile according to preferred embodiments of the present invention.
Figure 4B:
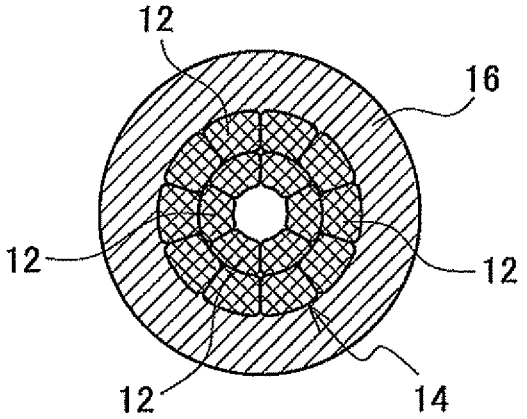

Detailed descriptions of preferred embodiments of the present invention will now be provided.

FIGS. 1A to 4B are sectional views showing examples of aluminum electric wires for an automobile according to the preferred embodiments of the present invention. An aluminum electric wire 10 for an automobile includes a conductor 14 that is a strand prepared by bunching elemental wires 12 made of an aluminum alloy, and an insulator 16 made of an insulating material, which covers the conductor 14. The aluminum electric wires 10 shown in FIGS. 1A to 1D each consists of the conductor 14 that is a strand prepared by bunching the elemental wires 12 and is compressed concentrically, and the insulator 16 covering the conductor 14. The aluminum electric wires 10 shown in FIGS. 2A to 2C each consists of the conductor 14 that is a strand prepared by concentrically bunching the elemental wires 12 and the insulator 16 covering the conductor 14. The aluminum electric wires 10 shown in FIGS. 3A and 3B each consists of the rope-ray conductor that is a strand prepared by bunching the elemental wires 12 and the insulator 16 covering the conductor 14. The aluminum electric wires 10 shown in FIGS. 4A and 4B each consists of the conductor that is a strand prepared by bunching the elemental wires 12 in two layers and the insulator covering the conductor 14. In each aluminum electric wire 10, the number of elemental wires 12 making up the conductor 14 is determined according to conditions such as the type of devices in which the aluminum electric wires 10 are to be used.

The aluminum alloy of which the elemental wires 12 are made contains predetermined amounts of Fe and Mg and the balance being Al and incidental impurities. The elemental wire 12 is annealed. The alloy composition is predetermined as above for the reasons described below. The following contents are expressed as a percentage by mass.

Containing Fe improves the strength of the elemental wires 12 while maintaining its electric conductivity. To produce this beneficial effect, the Fe content is preferably 0.90 to 1.20 mass %, and more preferably 1.00 to 1.20 mass %. If the Fe content is less than 0.90%, the beneficial effect of strength is not sufficiently improved, making it difficult for the elemental wires 12 to have a tensile strength of 110 MPa or more. In addition, the bending resistance is not sufficiently improved. In contrast, if the Fe content is more than 1.20 mass %, a defect in the rolling process tends to occur, and such a defect may not be prevented in the rolling process even if the aluminum alloy is casted by rapid solidification of a molten aluminum alloy using a continuous casting and rolling machine. A defect in the rolling process reduces the workability and elongation of the elemental wires 12.

Containing Mg improves the strength of the element wires 12. To produce this beneficial effect, the Mg content is preferably 0.10 to 0.25 mass %, and more preferably 0.10 to 0.20 mass %. If the Mg content is less than 0.10 mass %, the beneficial effect of strength is not sufficiently improved. In contrast, if the Mg content is more than 0.25 mass %, the electric conductivity falls below 58% IACS.

The aluminum alloy of which the elemental wire 12 is made may further contain Ti or B in addition to the elements described above.

Further containing Ti enables the aluminum alloy to have a microstructure in the casting process. Accordingly, occurrence of a defect in the rolling process is minimized, preventing the workability of the alloy, and the strength and elongation of the elemental wires 12 from decreasing, even when the Fe content is 0.90 mass % or more. To produce this beneficial effect, the Ti content is preferably 0.01 to 0.05 mass % and more preferably 0.01 to 0.03 mass %. If the Ti content is less than 0.01 mass %, the effect of miniaturizing the crystalline structure tends not to appear. In contrast, if the Ti content is more than 0.05 mass %, the electric conductivity tends to be reduced.

Further containing B improves the beneficial effect of microstructure of the aluminum alloy, which is produced by the addition of Ti. In other words, further containing B further minimizes occurrence of a defect in the rolling process. To produce this beneficial effect, the B content is preferably 0.0005 to 0.0025 mass %. If the B content is less than 0.0005 mass %, the effect of miniaturizing the crystalline structure is difficult to improve. In contrast, if the B content is more than 0.0025 mass %, the beneficial effect of miniaturizing the crystalline structure is not further improved.

The elemental wires 12 preferably have a tensile strength of 110 MPa or more, and more preferably have a tensile strength of 120 MPa or more. A wire having a conductor that is a strand prepared by bunching the elemental wires 12 having a strength of 110 Mpa or more can have crimping strength to a terminal sufficient for automobile use. For example, if the cross-sectional area of the wire having the conductor is 0.75 $mm^2$, the crimping strength to a terminal is 50 N or more, which gives the wire strength necessary for automobile use.

In addition to a tensile strength of 110 MPa or more, the elemental wires 12 preferably have a breaking elongation of 15% or more, and more preferably have a tensile strength of 120 MPa and a breaking elongation of 20% or more. If the tensile strength and the breaking elongation are within these ranges, a wire having a conductor that is a strand prepared by bunching the elemental wires 12 can have impact resistance sufficient for automobile use. For example, if the cross-sectional area of a wire is 0.75 $mm^2$, the impact resistance is 10 J/m or more, which gives the electric wire impact resistance necessary to be used for a wire harness assembly and improves also the bending resistance.

Further, the elemental wires 12 preferably have an electric conductivity of 58% IACS, and more preferably have an electric conductivity of 60% IACS or more. If the aluminum alloy elemental wires 12 have an electric conductivity of 58% IACS or more, making the cross-sectional area of the conductor 1.5 times as large as the cross-sectional area of a conventional copper wire enables the conductor to have an electric conductivity equivalent to or better than that of the conventional copper wire. Additionally, because the specific gravity of aluminum is about one third of that of copper, the conductor can be reduced in weight by about 50% or more.

In the aluminum alloy of which the conductor 14 is made, it is preferable that the amount of Fe in the form of solid solution is small and many Al—Fe precipitates exist. To be more specific, it is preferable that five or more Al—Fe precipitates exist in an area of 2400×2600 nm in a cross section (e.g., a radial cross section) of the annealed conductor 14 made of the aluminum alloy. When the Al—Fe precipitates exist in such quantity, the amount of Fe in the form of solid solution is small, thereby further improving the electric conductivity of the conductor. In addition, decrease in the elongation of the conductor is minimized, and thus the electric wire has excellent bending resistance and impact resistance. It is more preferable that ten or more Al—Fe precipitates exist in the area described above. The quantity of Al—Fe precipitates can be measured using a transmission electron microscope (TEM) for example. To be more specific, the quantity is measured by observing five or more portions of a single sample in which Al—Fe precipitates can be observed, and obtaining an average value of the quantities of Al—Fe precipitates in the portions.

The Al—Fe precipitate is a minute Al—Fe compound that precipitates in the annealing process after the aluminum alloy is casted by rapid solidification of the molten aluminum alloy. The particle size of the Al—Fe precipitate is not specifically limited, but often 200 nm or less. Examples of the shape of the Al—Fe precipitate include a spherical shape. Although another Al—Fe compound is also produced when solidifying the molten aluminum alloy, this compound is called an Al—Fe crystallization and is not considered as the Al—Fe precipitate. The Al—Fe crystallization produced during the solidification has a relatively larger particle size (often exceeding 200 nm) than the Al—Fe precipitate, and is thus distinguishable from the Al—Fe precipitate.

The insulating material of which the insulator 16 is made is not specifically limited, and it is only necessary that an insulating resin material such as polyvinyl chloride (PVC) and a non-halogen resin is used. A material with excellent flame-retardancy is preferably used. The thickness of the covering layer is not specifically limited.

Next, an example of a method for producing an aluminum electric wire for an automobile according to the preferred embodiment of the present invention is described. The method for producing an aluminum electric wire for an automobile according to the preferred embodiment of the present invention includes the steps of casting an aluminum alloy having the alloy composition described above, producing an aluminum alloy conductor from the casted aluminum alloy, subjecting the aluminum alloy conductor to annealing, and producing an aluminum electric wire from the aluminum alloy conductor.

In the casting step, a molten aluminum alloy having the alloy composition described above is prepared. To produce the molten aluminum alloy, pure metal that is the base material is molten in a melting furnace, and Fe and Mg are added in desired concentration to the molten pure aluminum. For the pure aluminum that is the base material, purified aluminum ingots having a purity of 99.7% or more is preferably used. For the Fe to be added, an Al—Fe mother alloy is preferably used. The molten aluminum alloy having the composition thus adjusted is subjected to a hydrogen gas removal process or a foreign matter removal process as necessary.

Then, the molten aluminum alloy is subjected to rapid solidification. By the rapid solidification, a casting can be obtained in which Fe is supersaturated and forms a solid solution. In addition, occurrence of a defect in a rolling process can be minimized by finely dispersing Al—Fe crystallizations. The cooling rate is not specifically limited but is preferably 20° C. per second or more at the temperature range of from 700 to 600° C., which is a solid-liquid coexisting temperature range. For the rapid solidification of the molten aluminum alloy, a continuous casting machine is preferably used that has a water-cooling copper casting die and a forced water cooling mechanism.

In the case of adding Ti and/or B to the molten aluminum alloy, adding Ti and/or B immediately before the casting process allows effective microstructuring of the aluminum alloy.

Next, the aluminum alloy conductor is produced. The casted aluminum alloy is subjected to plasticity processing to produce an aluminum alloy elemental wire. The aluminum alloy conductor may be made up of a single aluminum alloy elemental wire, or a plurality of aluminum alloy elemental wires that are a strand prepared by bunching the plurality of elemental wires, the elemental wires being produce as described above.

Specifically, a wire rod is produced by rolling the casted aluminum alloy and is then subjected to wire drawing processing. Then, the wire rod is drawn into an elemental wire having a desired diameter. The rolling may be performed by a continuous casting and rolling method preferably using tandem hot rolling mills. For example, a continuous casting and rolling machine driven by a belt & wheel method may be used. The wire drawing processing is preferably cold wire drawing processing.

The aluminum alloy conductor is then subjected to the annealing. By the annealing, the aluminum alloy conductor is provided with sufficient bending resistance and flexibility. In this step, the aluminum alloy conductor is heat treated. The treatment temperature is preferably 250° C. or more, and more preferably 300 to 400° C. At less than 250° C., the conductor is not sufficiently annealed. The heated aluminum alloy conductor is then cooled.

If the aluminum alloy conductor is a strand prepared by bunching a plurality of elemental wires, the annealing may be performed on the elemental wires before bunching, after bunching, or both before and after bunching.

The annealing may be either of batch-type annealing and continuous annealing, but the batch-type annealing is preferable. The batch-type annealing enables the aluminum alloy conductor to be cooled slowly after the annealing. Thus, the Fe in the solid solution is easily precipitated. In addition, the annealing temperature of the batch annealing is lower than that in the continuous annealing, allowing the precipitated Fe to be not easily incorporated into the solid solution again. Accordingly, the aluminum alloy conductor obtained with the batch-type annealing contains a small amount of Fe in the form of solid solution and thus has excellent electric conductivity. In addition, decrease in elongation of the conductor is minimized, which provides the electric wire with excellent bending resistance and impact resistance.

The batch-type annealing can be performed using a batch-type annealing furnace preferably having a shape of bell, pot, or box. In the batch-type annealing, the heating temperature is preferably within the range of from 250 to 400° C. In addition, the cooling time from the annealing temperature to 150° C. is preferably 10 minutes or longer. Under such treatment conditions, the amount of Fe in the form of solid solution is reduced to increase the quantity of Al—Fe precipitates. The heated aluminum alloy conductor is cooled (slowly cooled) preferably by furnace cooling or air cooling.

The annealing is performed preferably with the use of a continuous annealing furnace using electric heating or high-frequency induction heating. The continuous annealing furnace can minimize variations in characteristics in the longitudinal direction of the wire. In addition, allowing continuous heating and rapid cooling, the continuous annealing is suitably used for producing long objects such as wires.

The annealing is preferably performed under a non-oxidizing atmosphere. This is because increase of an oxide layer on the surface of the aluminum elemental wires is minimized, and thereby increase in the contact resistance at a terminal connection portion can be minimized. To provide a non-oxidizing atmosphere, the system may be brought into a vacuum (reduced pressure) state, into an atmosphere of an inert gas such as nitrogen and argon, or into an atmosphere of a reducing gas such as a hydrogen-containing gas and a carbon dioxide-containing gas.

Then, an aluminum electric wire is produced from the aluminum alloy conductor. The aluminum conductor may be compressed concentrically as necessary. The concentric compression of the annealed conductor can reduce the wire diameter. The prepared aluminum alloy conductor is covered with an insulating material to form the aluminum electric wire.

EXAMPLES

A more detailed description of the present invention will now be provided with reference to Examples.

Examples 1 to 5

Molten aluminum alloys having the respective alloy compositions shown in Table 1 were subjected to casting and hot rolling using a continuous casting and rolling machine driven by a belt & wheel method to produce wire rods of 9.5 mm in diameter. The wire rods were subjected to cold wire drawing processing to produce aluminum alloy elemental wires of 0.23 mm in diameter. Aluminum alloy conductors of strands each prepared by bunching nineteen elemental wires obtained as described above were heated for five hours in a batch-type annealing furnace under the respective conditions shown in Table 1. The heated aluminum alloy conductors were slowly furnace cooled. The cooling time necessary to cool the aluminum alloy conductors from the annealing temperatures (300° C. or 350° C.) to 150° C. was set to 60 minutes. The aluminum alloy conductors prepared as described above were each covered with a 0.2 mm thick halogen-free insulating material to produce the aluminum electric wires according to Examples 1 to 5.

Example 6

The aluminum electric wire according to Example 6 was produced in the same manner as the wires according to Examples 1 to 5, except that the aluminum alloy conductors were subjected to continuous annealing with the use of a continuous annealing machine using electric heating. The cooling time necessary to cool the aluminum alloy conductors from the annealing temperatures (500° C.) to 150° C. was one second or less.

Example 7

The aluminum electric wire according to Example 7 was produced in the same manner as Example 6, except that the molten aluminum alloy was subjected to billet casting using a billet casting machine.

Example 8

The aluminum electric wire according to Example 8 was produced in the same manner as Examples 1 to 5, except that the molten aluminum alloy was subjected to billet casting using a billet casting machine.

Comparative Examples 1 to 4

Aluminum electric wires having the respective alloy compositions shown in Table 1 were produced in the same manner as Examples 1 to 5.

Comparative Example 5

An aluminum electric wire having the alloy composition shown in Table 1 was produced in the same manner as Examples 1 to 5, except that no annealing was performed.

Figure 5:
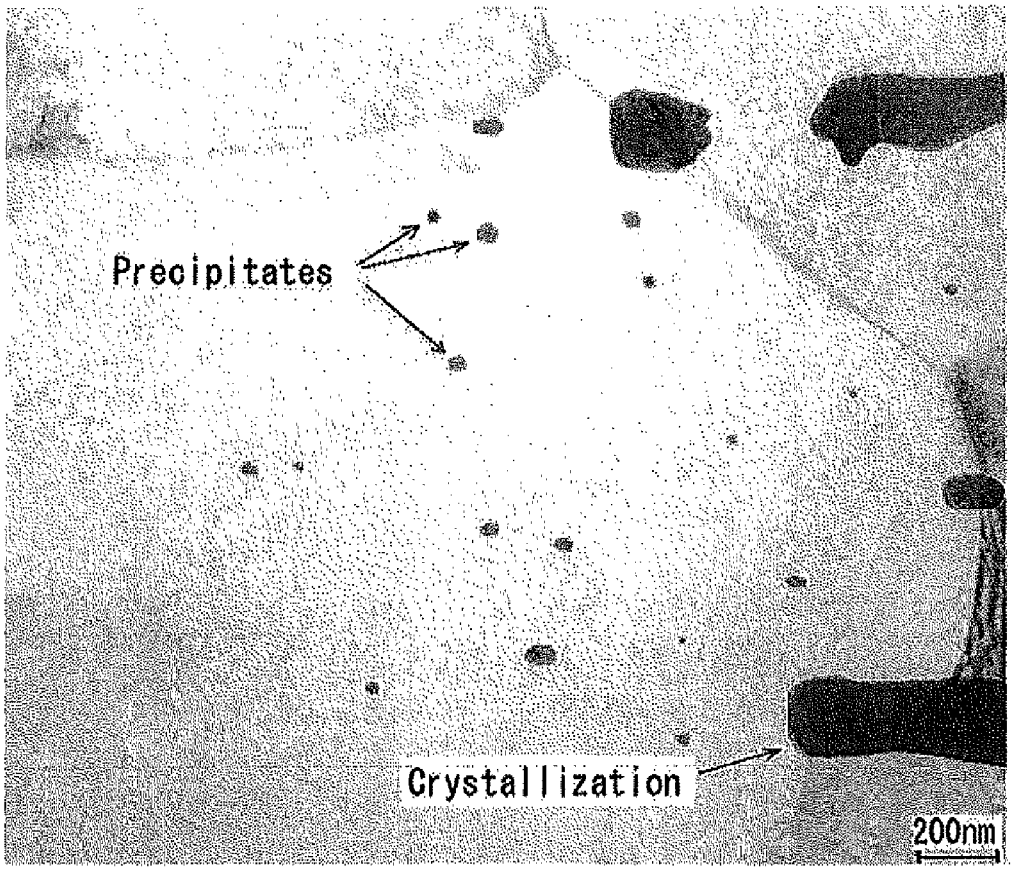
FIG. 5 is a TEM photograph showing a radial cross section of an aluminum alloy elemental wire that has been subjected to batch-type annealing.
Figure 6:
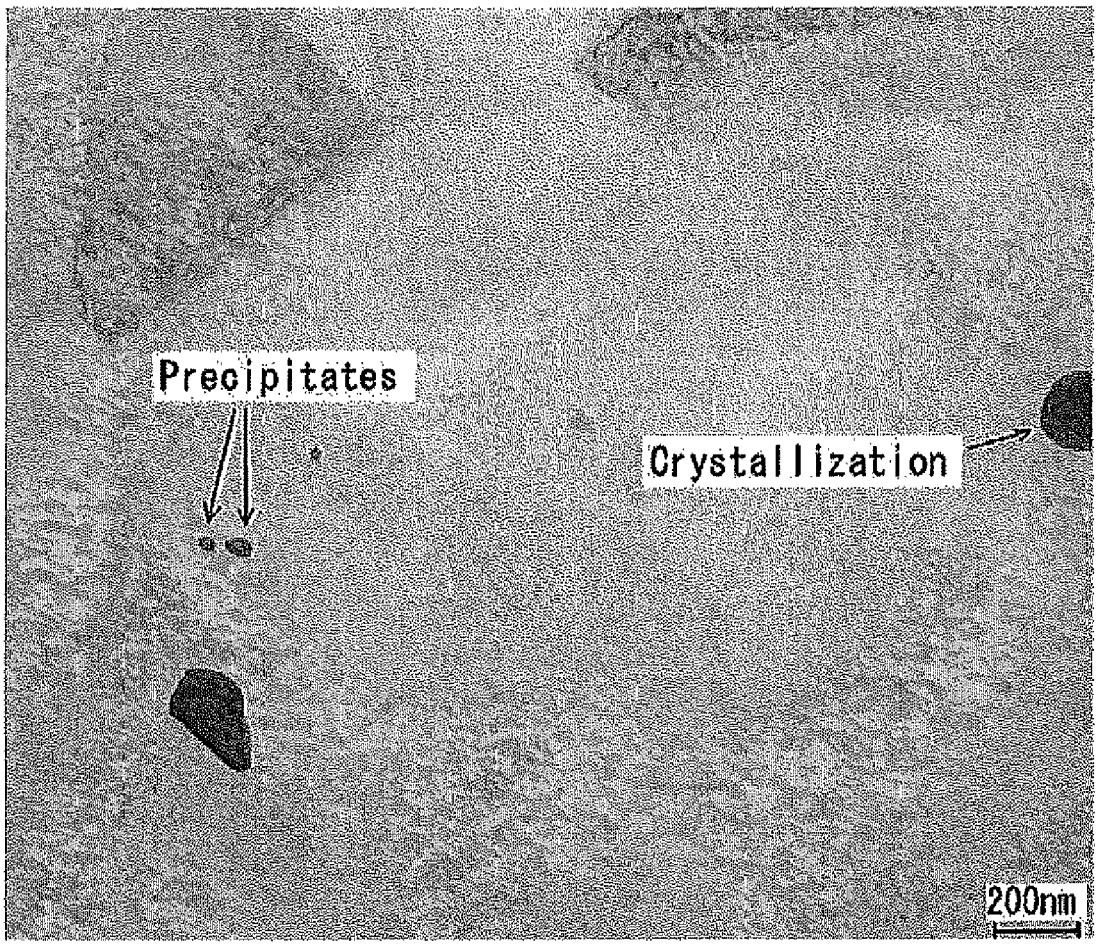
FIG. 6 is a TEM photograph showing a radial cross section of an aluminum alloy elemental wire that has been subjected to continuous annealing.

Each of the obtained aluminum alloy elemental wires was measured for workability, tensile strength, breaking elongation, and electrical conductivity. In addition, each of the obtained aluminum electric wire of 0.75 $mm^2$ in diameter was measured for impact absorption energy, crimping strength to a terminal, and bending resistance. The results are shown in Table 1. Radial cross-sections of the aluminum alloy elemental wires according to Examples 5 and 6 were observed with a TEM (Transmission Electron Microscopy) to measure the quantity of Al—Fe precipitates. The quantity of Al—Fe precipitates was measured in five portions each having an area of 2400×2600 nm in which Al—Fe precipitates can be observed. Then, an average value of the five portions was obtained. FIGS. 5 and 6 show photographs of the areas of 2400×2600 nm of the radial cross sections of the aluminum alloy elemental wires according to Examples 5 and 6.

(Tensile Strength)

Tensile strength was measured in accordance with JIS Z 2241 (Method for Tensile Test for Metallic Materials) using a common tensile strength tester. The aluminum alloy elemental wires having a tensile strength of 110 MPa or more was regarded as satisfactory.

(Breaking Elongation)

Breaking elongation was measured in accordance with JIS Z 2241 (Method for Tensile Test for Metallic Materials) using a common tensile strength tester. The aluminum alloy elemental wires having a breaking elongation of 15% or more was regarded as satisfactory.

(Electric Conductivity)

Electric conductivity was measured using a bridge method. The aluminum alloy elemental wires having an electric conductivity of 58% IACS (International Annealed Copper Standard) or more was regarded as satisfactory.

(Workability)

Workability in the hot rolling process and the cold wire drawing processing was evaluated. Workability of the wire rod of 9.5 mm in diameter in the hot rolling process was evaluated based on the number of defects detected by a defect detector. Workability in cold wire drawing processing was evaluated based on a numerical value obtained by dividing the number of breaks in the aluminum elemental wire by the wire length after drawing. The aluminum alloy elemental wires having numerical values equal to or larger than that of a conventional aluminum elemental electric wire for an electric wire (an EC aluminum electric wire), which is of an annealed type, were regarded as Good, and the lower numerical values were regarded as Poor.

(Impact Absorption Energy (Impact Resistance Energy))

Impact absorption energy was measured by attaching a weight to an end of each wire conductor having a gauge length of 1 meter, and lifting the weight by 1 meter and then dropping freely. It was defined that when the maximum weight of the weight with which the wire is not broken is expressed as W(N), the impact absorption energy is expressed as W(J/m). The aluminum electric wire having an impact absorption energy (an impact resistance energy) before break of 10 J/m or more was regarded as satisfactory.

(Bonding Strength to a Terminal)

A terminal was crimped to one end of each of the aluminum electric wires where the insulator has been removed, and the both ends of each of the aluminum electric wires were attached to chucks of a common tensile tester and pulled to break. The loads imposed on the aluminum electric wires at the times of break were measured. The aluminum electric wires that broke under the load of 50 N or more were regarded as satisfactory.

(Bending Resistance)

A bending test was performed in which the electric aluminum wires were each subjected to ±90 degree bends around a mandrel, and the electric aluminum wires having a life twice or more as long as a conventional aluminum elemental wire for an electric wire (an EC aluminum electric wire), which is of an annealed type, were regarded as satisfactory.

TABLE 1

| | | Alloy composite (mass %) | | | | | Production condition | | | |
|---|---|---|---|---|---|---|---|---|---|---|
| | | | | | | | Casting | Softening condition | | |
| | | Fe | Mg | Ti | B | Al | condition | Type | Temperature | Atmosphere |
| Example | 1 | 1.05 | 0.15 | — | — | Bal. | Continuous | Batch | 350 | Reducing gas |
| | 2 | 1.10 | 0.23 | 0.12 | — | Bal. | Continuous | Batch | 300 | Nitrogen |
| | 3 | 1.00 | 0.15 | 0.01 | 0.0005 | Bal. | Continuous | Batch | 350 | Reducing gas |
| | 4 | 0.95 | 0.23 | 0.02 | 0.0010 | Bal. | Continuous | Batch | 350 | Argon |
| | 5 | 1.05 | 0.15 | 0.03 | 0.0015 | Bal. | Continuous | Batch | 350 | Reducing gas |
| | 6 | 1.05 | 0.15 | 0.03 | 0.0015 | Bal. | Continuous | Continuous | 500 | Nitrogen |
| | 7 | 1.05 | 0.15 | 0.03 | 0.0015 | Bal. | Billet | Continuous | 500 | Nitrogen |
| | 8 | 1.05 | 0.15 | 0.03 | 0.0015 | Bal. | Billet | Batch | 350 | Reducing gas |
| Comparative example | 1 | 0.85 | 0.05 | — | — | Bal. | Continuous | Batch | 350 | Reducing gas |
| | 2 | 1.25 | 0.30 | — | — | Bal. | Continuous | Batch | 350 | Reducing gas |
| | 3 | 1.05 | 0.05 | — | — | Bal. | Continuous | Batch | 350 | Reducing gas |
| | 4 | 1.05 | 0.50 | — | — | Bal. | Continuous | Batch | 350 | Reducing gas |
| | 5 | 0.95 | 0.15 | 0.01 | 0.0005 | Bal. | Continuous | — | — | — |

| | | Material property | | | Wire performance | | | |
|---|---|---|---|---|---|---|---|---|
| | | Tensile strength Mpa | Elongation % | Electric conductivity % IACS | Workability | Impact resistance energy J/m | Crimping strength to terminal N | Bending resistance |
| Example | 1 | 115 | 25 | 60 | Good | 16 | 52 | Good |
| | 2 | 125 | 15 | 58 | Good | 10 | 56 | Good |
| | 3 | 115 | 20 | 59 | Very good | 13 | 52 | Good |
| | 4 | 125 | 18 | 58 | Very good | 12 | 54 | Good |
| | 5 | 115 | 25 | 60 | Very good | 14 | 52 | Good |
| | 6 | 115 | 21 | 58 | Very good | 13 | 52 | Good |
| | 7 | 115 | 15 | 58 | Very good | 10 | 52 | Good |
| | 8 | 115 | 15 | 60 | Very good | 10 | 52 | Good |
| Comparative example | 1 | 96 | 25 | 62 | Very good | 13 | 43 | Poor |
| | 2 | 135 | 10 | 55 | Poor | 7 | 61 | Good |
| | 3 | 105 | 20 | 59 | Good | 12 | 47 | Good |
| | 4 | 135 | 10 | 53 | Good | 7 | 61 | Good |
| | 5 | 176 | 2 | 59 | Good | 2 | 79 | Good |

As clearly shown in Table 1, the materials according to the Examples are excellent in tensile strength, breaking elongation, and electric conductivity, and the wires made from the materials are excellent in workability, impact resistance, bonding strength to a terminal, and bending resistance. The electric conductivities are 58% IACS or more. In addition, the materials are reduced in weight compared with a conventional copper wire because of the use of the aluminum alloy.

A comparison between Examples 5 and 6 indicates that the batch-type annealing can further improve the electric conductivity and minimize decrease in elongation. This fact is also indicated by a comparison between Examples 7 and 8. In addition, FIGS. 5 and 6 show that the batch-type annealing can provide the aluminum alloy elemental wires with a significantly greater quantity of Al—Fe precipitates than the continuous annealing. The quantity of Al—Fe precipitates in the observation area of the aluminum alloy elemental wire according to Example 5 (subjected to the batch-type annealing) is twelve, whereas the quantity of Al—Fe precipitates in the observation area of the aluminum alloy elemental wire according to Example 6 (subjected to the continuous annealing) was three.

It is to be noted that FIGS. 5 and 6 show observation examples of cross sections of the aluminum alloy elemental wire subjected to the batch-type annealing and the aluminum alloy elemental wire subjected to the continuous annealing, respectively. These differences in quantity of the Al—Fe precipitates according to the type of annealing are also found in the aluminum alloy wires according to the other Examples.

A comparison between Examples 5 and 8 indicates that continuous casting minimizes decrease in elongation of the aluminum alloy elemental wires better than the billet casting. This fact is also indicated by a comparison between Examples 6 and 7.

Compared with the Examples, the aluminum alloy according to Comparative Example 1 contains smaller amounts of Fe and Mg and thus has poor tensile strength, which results in poor bonding strength to a terminal and bending resistance of the aluminum electric wires. The aluminum alloy according to Comparative Example 2 contains larger amounts of Fe and Mg and thus has poor breaking elongation and electric conductivity, which results in poor workability and impact resistance of the aluminum electric wires. The aluminum alloy according to Comparative Example 3 contains a smaller amount of Mg and thus has poor tensile strength, which results in poor bonding strength to a terminal of the aluminum electric wires. The aluminum alloy according to Comparative Example 4 has a larger mount of Mg and thus has poor breaking elongation and electric conductivity, which results in poor impact resistance of the aluminum electric wire. The aluminum alloy elemental wire according to Comparative Example 5 is not annealed because no annealing was performed thereon and thus has significantly poor breaking elongation, which results in poor impact resistance of the aluminum electric wire.

The foregoing description of the preferred embodiments of the present invention has been presented for purposes of illustration and description. However, it is not intended to limit the present invention to the preferred embodiments described herein, and modifications and variations are possible as long as they do not deviate from the principles of the invention.

For example, described in EXAMPLES described above is the configuration of the aluminum alloy conductors each of which is a strand prepared by bunching nineteen elemental wires; however, the present invention is not limited to this configuration.

The invention claimed is:

1. A method for producing an aluminum electric wire for an automobile, the method comprising the steps of:

casting an aluminum alloy that is prepared by rapidly solidifying a molten aluminum alloy containing 0.90 to 1.20 mass % Fe, 0.10 to 0.25 mass % Mg, and a balance being Al and incident impurities;

producing an aluminum alloy conductor from the aluminum alloy by subjecting the aluminum alloy to plasticity processing;

applying batch-type annealing to the aluminum alloy conductor such that an annealed conductor is produced; and covering the annealed conductor with an insulating material, wherein the annealed conductor is made up of elemental wires made of the aluminum alloy, each of the elemental wires having: (i) a tensile strength of 110 MPa or more, (ii) a breaking elongation of 15% or more, and (iii) an electric conductivity of 58% IACS or more, and in the batch-type annealing, a heating temperature is in a range from 250° C. to 400° C., and a cooling time of cooling the aluminum alloy conductor from an annealing temperature to 150° C. is at least ten minutes or greater.

2. The method according to claim 1, wherein 0.01 to 0.05 mass % Ti is added to the molten aluminum alloy immediately before the rapid solidification.

3. The method according to claim 2, wherein 0.0005 to 0.0025 mass % B is added to the molten aluminum alloy immediately before the rapid solidification.

4. The method according to claim 1, wherein the annealing is performed under a non-oxidizing atmosphere.

5. The method according to claim 2, wherein the annealing is performed under a non-oxidizing atmosphere.

6. The method according to claim 3, wherein the annealing is performed under a non-oxidizing atmosphere.

7. The method according to claim 1, further comprising the step of concentrically compressing the aluminum alloy conductor.

8. The method according to claim 2, further comprising the step of concentrically compressing the aluminum alloy conductor.

9. The method according to claim 3, further comprising the step of concentrically compressing the aluminum alloy conductor.

* * * * *